United States Patent [19]

Leifels et al.

[11] 4,367,171

[45] Jan. 4, 1983

[54] COATING COMPOSITIONS FOR THE MANUFACTURE OF COATED PAPERS

[75] Inventors: Klaus D. Leifels, Binningen; Alfred Renner, Münchenstein; Franz R. Widmer, Basel, all of Switzerland

[73] Assignee: Ciba-Geigy AG, Basel, Switzerland

[21] Appl. No.: 49,966

[22] Filed: Jun. 19, 1979

Related U.S. Application Data

[63] Continuation of Ser. No. 641,587, Dec. 16, 1975, abandoned.

[30] Foreign Application Priority Data

Dec. 16, 1974 [CH] Switzerland ..... 16673/74

[51] Int. Cl.[3] ..... C08L 61/24; C08L 3/02; C08L 9/06

[52] U.S. Cl. ..... 524/47; 524/425; 524/447

[58] Field of Search ..... 260/17.3, 29.4 R, 29.4 VA

[56] References Cited

U.S. PATENT DOCUMENTS 3,928,272 12/1975 Brancato ..... 260/29.4 R 3,953,421 4/1976 Berstein ..... 260/17.3

FOREIGN PATENT DOCUMENTS 2100907 11/1971 Fed. Rep. of Germany .

OTHER PUBLICATIONS

Renner, Die Makromolekulare Chemie, 149, 1-27, (1971).

*Primary Examiner*—James R. Hoffman
*Attorney, Agent, or Firm*—Wenderoth, Lind & Ponack

[57] ABSTRACT

A coating composition for paper is provided, which composition consists of an aqueous preparation containing at least a polymeric binder, an inorganic pigment, and a water-insoluble urea-formaldehyde polycondensation product from 1 mole of urea and 1.3 to 2 moles, of formaldehyde, which product is in a highly dispersed form and has a mean particle diameter of 3 to 6 microns, and a specific BET surface urea of 3 to 12 $m^2/g$.

Papers coated with these compositions exhibit, in addition to an enhanced degree of whiteness and equally good gloss and improved opacity and smoothness, above all better printability.

8 Claims, No Drawings

COATING COMPOSITIONS FOR THE MANUFACTURE OF COATED PAPERS

This application is a continuation of application Ser. No. 641,587, filed Dec. 16, 1975 (now abandoned).

The invention relates to a coating composition for paper, which composition consists of an aqueous preparation containing at least (a) a polymeric binder, (b) an inorganic pigment, and (c) a water-insoluble urea-formaldehyde polycondensation product from 1 mole of urea and 1.3 to 2 moles, preferably 1.3 to 1.8 moles and particularly 1.5 moles, of formaldehyde, which product is in a highly dispersed form and has a mean particle diameter of 3 to 6 microns, preferably 3 to 5 microns, particularly 3 to 4 microns, and a specific BET surface area of 3 to 12 $m^2/g$, preferably 4 to 10 $m^2/g$, and especially 5 to 8 $m^2/g$.

The specific BET surface area is determined by means of nitrogen adsorption according to Brunauer, Emmett and Teller [see J. Am. Chem. Soc. 60, 309–319 (1938), also Chemie-Ing. Techn. 32, 349–354 (1960) and 35, 568–598 (1963)].

The solid content of the coating composition is as a rule 40 to 70 percent by weight, preferably 54 to 60 percent by weight, and the composition has a viscosity, measured according to Brookfield with 100 revolutions per minute and at 25° C., of 1000 to 1600, preferably 1200 to 1500 cP.

This coating composition contains, in general, relative to the total weight of the constituents (b) and (c), 75 to 98 percent by weight, preferably 85 to 97 percent by weight, of the constituent (b) and 25 to 2 percent by weight, preferably 15 to 3 percent by weight, of the constituent (c).

Relative to the total weight of the constituents (b) and (c), the coating composition contains 5 to 30 percent by weight, preferably 5 to 15 percent by weight, of the constituent (a).

The coating compositions contain as constituent (a) the polymeric binder systems normally used in the paper industry. It is therefore possible to use within the scope of the invention, in particular, any of the known, modified or converted varieties of starch, such as oxidised, hydrolysed or hydroxyethylated starches. In addition to the various types and varieties of starch, it is possible to use, in particular, other polymeric binder systems singly or in combination (with starches or with each other), e.g. casein, soya protein or polyvinyl alcohol, and many different types of latex, e.g. polyvinyl acetate, or preferably styrene/butadiene copolymers, and the widest range of acrylic polymers such as polyacrylic acid, polyethyl acrylate or polymethylmethacrylate.

The constituents (b) and (c) together form the pigment solids of the coating composition. Suitable as constituent (b) are the usual inorganic pigments that are used in paper-coating compositions, e.g. talcum, titanium dioxide or extended titanium dioxide compounds, aluminium oxide, barium sulphate, calcium sulphate, satin white, zinc oxide, silicon dioxide and, in particular, precipitated calcium carbonate and/or kaolins. The fine varieties of kaolin (mean particle size to the extent preferably of 80% less than $2\mu$) have become by far the most frequently employed pigments for the coating of paper. In the publishing field in particular, these varieties of kaolin which are suitable for coating paper frequently make up essentially the entire, or almost the entire, part of all the pigment solids in the paper-coating compositions that are normally used.

There are preferably used as constituent (b) the so-called coating kaolins.

As constituent (c) there are used the aforementioned high-molecular, water-insoluble, finely divided urea-formaldehyde polymers.

It is true that these organic white pigments are derived originally from the usual urea-formaldehyde condensation reaction, but they are not to be confused with conventional, fusible and soluble urea-formaldehyde resins that have hitherto been used as binder additives, adhesives, etc. These urea-formaldehyde polymers serving as pigments for the purposes of the invention in no way reduce or replace the binder constituents required in the coating composition; they are in fact to be regarded as substitute for a small part of the usual inorganic pigments used.

The chemical and physical properties of the pulverulent, finely divided urea-formaldehyde polymers used as auxiliary pigments or constituent (c) for the purposes of the invention can be achieved by means of the preferred processes for the production thereof, which processes are described in detail in the following.

The constituent (c) and processes for its production are known per se (see A. Renner: [Die Makromolekulare Chemie' [Macromolecular Chemistry] 149, 1–27 (1971)). The molecular ratio of urea to formaldehyde, which are chemically bound in the structure of these resins, is, as already mentioned, generally between about 1:1.3 and 1:2. With a molecular ratio of urea to formaldehyde of $1:<1.3$, a constituent (c) having a BET surface area of $>12$ $m^2/g$ is obtained.

The urea-formaldehyde polymers according to the invention can be easily produced by reaction of formaldehyde with urea in the mentioned proportions in an aqueous solution under suitable conditions.

The formation reaction of the urea-formaldehyde polymer is preferably performed in two stages. In the first stage, the urea and the formaldehyde are allowed to react normally by the usual condensation mechanism to form a low-molecular, water-soluble pre-condensate, whereupon in the second stage the acid cross-linking catalyst is introduced in order to accelerate the reaction and cross-linking, in consequence of which the insoluble, finely divided solid substance is formed.

The amount of water in the reaction solution should never by appreciably less that the total weight of the organic reactants present therein, and during the actual formation and precipitation of the insoluble polymer particles the amount of water should be considerably in excess of the overall weight of all other constituents of the reaction mixture.

The reaction temperature in the first stage, i.e. during the formation of the pre-condensate, is in general in the range of about 20° C. to about 100° C., with a range of about 40° to 85° C., especially 60° to 80° C., being most advantageous. Furthermore, the pH-value is adjusted to 6 to 9, preferably to 6.5 to 7.5, by the addition of an aqueous, inorganic strong base, e.g. a sodium hydroxide solution. The formation of the pre-condensate is as a rule complete after ½ to 3 hours.

It can moreover be advantageous to perform the step of forming the pre-condensate in the presence of a surface-active, ionic or nonionic compound, e.g. in the presence of a cation-active quaternary ammonium base, an anion-active fatty alcohol sulphonate, a nonionic polyethylene ether, or, in particular, in the presence of a salt of a sulphosuccinic acid ester, especially the sodium salt of dodecylbenzene sulphonic acid. The employed amount of such surface-active compounds is generally 0 to 3%, possibly 1 to 3%, relative to the total sum of the urea and formaldehyde used. Ionic surface-active compounds produce an increase of the specific surface area of the constituent (c), whereas nonionic compounds tend rather to produce the opposite effect.

The use of a macromolecular water-soluble protective colloid of possible polyelectrolyte character can also be advantageous during the formation of the precondensate, i.e. during the first stage of the reaction. Suitable for this purpose are, e.g., gelatine, tragacanth, agar-agar or polyvinylpyrrolidones, particularly copolymers of acrylic and methacrylic acid, especially polymethacrylic acid. As in the case of the surface-active compounds, the applied amount is 0 to 3%, possibly 1 to 3%, relative to the total weight of the employed urea and formaldehyde. Polyvinylpyrrolidones and polymethacrylic acid produce no increase of the specific surface area of the constituent (c).

One of the most important conditions for the successful production of infusible and insoluble, finely divided urea-formaldehyde polymers of the quality that is required for their use as auxiliary pigment within the scope of the invention is the application, in the second stage of the reaction, of a suitable gelation catalyst during the polymer-forming reaction, such as relatively strong inorganic and/or organic acids, e.g. sulphuric acid, sulphamic acid, phosphoric acid, sulphurous acid, hydrochloric acid, chloroacetic acid, maleic acid or the anhydride thereof. In general, these acids serving as gelation catalysts should have an ionisation constant of more than about $10^{-4}$. Sulphuric acid is however particularly preferred as a catalyst for producing the constituent (c). Of predominant interest are also the acid ammonium and amine salts of sulphuric acid, e.g. ammonium hydrogen sulphate, methylamine hydrogen sulphate or ethanolamine hydrogen sulphate.

The acids are normally used in the form of 1 to 15 percent (by weight) aqueous solutions.

As a rule, there are used 20 to 100 millimoles of the cross-linking catalyst per mole of employed urea, which produces a lowering of the pH-value of the reaction mixture in the second stage, i.e. during the polymer-forming reaction, to 3.0 to 1.5.

With sulphamic acid there is obtained in general a constituent (c) having a relatively high specific surface area, whereas the other aforementioned acids, especially sulphuric acid and ammonium and amine salts thereof, have the opposite effect.

The reaction temperature in the second stage, i.e. during the resin-formation reaction, is generally 20° to 100° C., preferably 40° to 85° C., and especially 40° to 65° C. Severe variations of the temperature of the reaction mixture when the catalyst is added are to be avoided. It is therefore advantageous to preheat the aqueous catalyst solutions to the temperature of the reaction mixture before the addition is made. In general, there is obtained a white gel within only 15 to 30 seconds. The cross-linking reaction is subsequently completed as a rule within ½ to 3 hours.

The resulting insoluble polymer, which is in the form of a white gel, is mechanically pulverised; approximately the same parts of water are added, the pH-value is brought to 6 to 9, preferably 7.5, with alkali or ammonia, preferably with sodium hydroxide solution, and the aqueous liquid is subsequently removed by the usual methods, e.g. by filtration, centrifuging and concentration by evaporation. Drying can be carried out by various processes, e.g. by spray drying or by convection drying. Although the final solid substance consists essentially of fine particles, it is advantageous to subject the solid product to a particle-size reducing operation or to a deagglomerating process, in order to reduce the mean agglomerate size and to increase the absorption values for oil or other liquids, and to thus utilize the full potentiality of the product as an auxiliary pigment powder within the scope of the invention. The cross-linked condensation product can to this end be reduced in size in various size-reducing devices or impact mills, e.g. in ball mills, dowelled disk mills, jet mills or mills operating with high-speed rotating disks. There is obtained after grinding a powder having a bulk density of at least 100 and at most 200 g/l, in most cases 120 to 180 g/l.

The constituent (c) itself is insoluble in water, but can be dissolved, e.g., in hot formic acid or in saturated aqueous solutions of lithium bromide.

The coating compositions of the invention can contain, in addition to the constituents (a), (b) and (c), also the standard additives that are used in conventional paper-coating compositions based on kaolin or on other inorganic pigments.

There can for example be used various auxiliary additives such as dyestuffs, waxes, dispersing agents, wetting agents or other surface-active agents, viscosity-regulating agents, antifoaming agents, lubricants, plasticisers and preservatives.

The coating compositions of the invention can be produced by processes already introduced and in use in industry. In general in these processes there is firstly produced an aqueous solution or colloidal dispersion of the binding agent, in many cases, particularly with starch, complete dissolving can be accelerated frequently by heating or boiling in the aqueous medium. The pigments can be added to the aqueous binder medium either before or after the complete dissolving of the binding agent, and can be completely dispersed therein. The inorganic pigments are often preliminarily dispersed in the form of a concentrated aqueous suspension before being added to the binder medium; however, this step is more a matter of convenience than of necessity. The pulverulent cross-linked urea-formaldehyde resin used as auxiliary pigment can in every case be easily added at almost any stage of the mixing processes described above. For example, it can be dispersed either in the binder medium or in a predispersed suspension of the inorganic pigment before the bringing together of these two constituents; or it can be added to the mixture of the two constituents after they have been brought together. It can therefore prove advantageous to incorporate the resin pigments shortly before completion of the mixing process, together with any of the various remaining additives necessary for the obtainment of a finished homogeneous suspension of the desired consistency. Although the polymer pigments have a very low bulk density, they are not difficult to handle, and the methods of handling and incorporation into the coating compositions in practice have numerous variations. The coating compositions are subsequently diluted with water to give the required solid content.

The improved coating compositions of the invention for gravure-printing papers and offset-printing papers are effective with a low overall coating weight per unit of surface area, and consequently render possible the production of coating printing papers, particularly papers for four-colour gravure or offset printing, having less weight after the finishing process.

Coated papers can be produced with the coating compositions of the invention by a process in which the base papers are coated, at least on one side, with a coating composition of the invention, dried and optionally calendered.

In particular the procedure is such that the base paper is coated on one side or preferably on both sides with the coating composition of the invention, with this being performed in two operations or preferably in one. The base paper used preferably has a weight of 30 to 120 g/m$^2$, preferably 30 to 80 g/m$^2$, particularly 50 to 70 g/m$^2$. Especially good results are obtained with base paper having a weight of 35 to 45 g/m$^2$.

The procedure is carried out as a rule in such a manner that the adhering coating has a weight of 5 to 20 g/m$^2$. Depending on the type of paper, the number of coatings and the composition of the coating, the finished coated paper has a weight of 35 to 160 g/m$^2$, preferably 35 to 120 g/m$^2$, and especially 50 to 80 g/m$^2$.

Compared with coated papers obtained with known coating compositions which do not contain the constituent (c) of the quality used according to the invention, there are obtained with the paper-coating compositions of the invention coated papers which exhibit, in addition to an enhanced degree of whiteness and equally good gloss and improved opacity and smoothness, above all better printability. The improved printability is illustrated by the fact that the absorptive capacity for printing inks in gravure printing is increased, the printed designs are more brilliant, the printing ink "stands" better and the printing displays less missing dots. There is also obtained the level of absorptive capacity that is necessary for Laser-beam-etched printing blocks.

Furthermore, the coating compositions of the invention have an advantage of a commercial nature in that with the dilution to the viscosity that is required in the paper industry the solid content can be made higher than that in the case of known coating compositions. An increase of the solid content of coating compositions by merely one percent by weight effects a saving of approximately 5% of water, which represents a corresponding saving in energy costs since that much less water has to be evaporated off.

Parts and percentages in the following Manufacturing Instructions and Examples relate to weight.

Manufacturing instructions for polymers from urea and formaldehyde

A. 3.15 parts of the sodium salt of dodecylbenzenesulphonic acid and 90 parts of urea (1.5 moles) are dissolved in 154 parts of water and 225 parts of a 30% aqueous formaldehyde solution (2.25 moles of formaldehyde or 1.5 moles of formaldehyde per mole of urea). The pH-value is brought to 7.0 with 2 N sodium hydroxide solution and is maintained there, while the temperature is raised to 70° C. After 2 hours, the reaction mixture is cooled to 50° C., and is then intimately mixed with a sulphuric acid solution at 50° C. (4.4 parts of 98% sulphuric acid, corresponding to 29 millimoles per mole of urea, 157.5 parts of water). After a short time the solution has gelled to form a white solid substance, and the temperature has risen to 65° C. After 2 hours at 65° C., the gel is mechanically pulverised and the same parts of water are added; the pH-value is brought to 7.5 with 2 N sodium hydroxide solution; the product is separated by filtration and subsequently dried at 120° C. until the weight is constant. There are obtained 113 parts of a white powder having a specific BET-surface area of 6.5 m$^2$/g.

By means of grinding in a dowelled disk mill, there is obtained a powder having a mean particle size of 5–6 microns and a bulk density of 150 g/liter.

B. to H. The procedure is carried out as in Instruction A except that there are used, instead of 4.4 parts of 98% sulphuric acid and 157.5 parts of water, the amounts given in the following Table I for the respective acids. The gelled solid substances obtained in this manner are subsequently processed as described in Instruction A. The specific BET-surface areas of the resulting powders after drying and the mean particle sizes of the resulting powders after grinding are likewise summarised in the following Table I.

TABLE I

| Instruction | B | C | D | E | F | G | H |
|---|---|---|---|---|---|---|---|
| hydrochloric acid (37%) (parts) | 4.5 | — | — | — | — | — | — |
| (millimoles per mole of urea) | 30 | — | — | — | — | — | — |
| ammonium hydrogen sulphate (parts) | — | 5.8 | — | — | 17.5 | — | — |
| (millimoles per mole of urea) | — | 33 | — | — | 99 | — | — |
| methylamine hydrogen sulphate (parts) | — | — | 6.5 | — | — | 19.6 | — |
| (millimoles per mole of urea) | — | — | 33 | — | — | 99 | — |
| ethanolamine hydrogen sulphate (parts) | — | — | — | 8.1 | — | — | 24.3 |
| (millimoles per mole of urea) | — | — | — | 33 | — | — | 99 |
| water for dissolving the above acids (parts) | 157.5 | 240 | 240 | 240 | 192 | 192 | 186 |
| specific BET-surface area (m$^2$/g) | 3.6 | 3.0 | 3.0 | 3.4 | 6.5 | 9.9 | 11.5 |
| mean particle size (micron) | 6.2 | 4.6 | 5.2 | 5.3 | 5.8 | 6.0 | 4.4 |

I. 90 parts of urea (1.5 moles) are dissolved in 106 parts of water and 195 parts of a 30% formaldehyde solution (1.95 moles of formaldehyde or 1.3 moles of formaldehyde per mole of urea) and, as described in Instruction A, the solution is heated at 70° C. and maintained at pH 7 for 2 hours and then cooled to 50° C.; there are subsequently added 4.9 parts of sulphamic acid (corresponding to 34 millimoles per mole of urea) which are dissolved in 135 parts of water at 50° C. The resulting gel is subsequently further processed as described in Instruction A. There is obtained a white powder having a specific BET-surface area of 5.1 m$^2$/g and a mean particle size after grinding of 4.8 microns.

J. 3.3 parts of polymethacrylic acid as well as 90 parts of urea (1.5 moles) are dissolved in 278 parts of water and 250 parts of a 30% aqueous formaldehyde solution (2.5 moles of formaldehyde or 1.67 moles of formaldehyde per mole of urea; and then, as described in Instruction A, the solution is maintained at 70° C. and at pH 7 for 2 hours and cooled to 50° C.; there are subsequently added 4.83 parts of maleic acid anhydride (corresponding to 33 millimoles per mole of urea) which are dissolved in 31 parts of water at 50° C. There is obtained a white gel which is further processed as described in Example 1. The resulting product is a fine white powder having a specific BET-surface area of 7.8 $m^2/g$ and a mean particle size after grinding of 5.5 microns.

EXAMPLE 1

In the usual manner there is produced a paper-coating composition of the following composition for a so-called LWC gravure-printing paper (LWC=light weight coated):

0.3 part of sodium polyphosphate,
0.2 part of sodium hydroxide,
0.05 part of antifoaming agent,
0.25 part of an optical brightener, e.g. of a bis-4,6-disubstituted triazinylamino-stilbene-2,2'-disulphonic acid,
88 parts of coating kaolin,
12 parts of urea-formaldehyde polymer according to Manufacturing Instruction A,
5.1 parts of butadiene-styrene copolymer, and
0.5 part of ammonium stearate.

This coating composition is diluted with water to give a solid content of 54.5%. The viscosity, measured according to Brookfield at 25° C. and 100 revolutions per minute, is 1500 cP. With this coating composition there is coated on both sides, in one operation on a blade coater, a base paper having a base weight of 38–39 $g/m^2$. The coated paper has a weight of 64–65 $g/m^2$ before subsequent calendering. After calendering, the coated paper has an increased length and therefore a reduced weight of 61–62 $g/m^2$.

The finished coated paper has an enhanced degree of whiteness, an improved opacity and, in particular, an improved absorptive capacity for printing inks.

Similar results are obtained with the urea-formaldehyde polymers according to Instructions B to H.

EXAMPLE 2

There is produced in the usual manner a paper-coating composition of the following composition for an LWC roller-offset-printing paper:

0.1 part of sodium polyphosphate,
0.2 part of polyethylacrylate,
0.1 part of sodium hydroxide,
72 parts of coating kaolin,
20 parts of precipitated calcium carbonate,
8 parts of urea-formaldehyde resin according to Manufacturing Instruction I,
12 parts of polyacrylic acid,
0.5 part of carboxymethylcellulose,
0.3 part of a pentamethylolmelamine-methyl ether.

This coating composition is diluted with water to give a solid content of about 57%. The viscosity, measured according to Brookfield at 25° C. and 100 revolutions per minute, is 1300 cP. With this coating composition there is coated on both sides on a blade coater, in one operation, a base paper having a base weight of 40 $g/m^2$. The coating weights are 12 $g/m^2$ on the side next to the wire cloth and 10 $g/m^2$ on the top side.

The finished, coated and calendered paper displays an enhanced degree of smoothness and whiteness and, in particular, in the printing process an improved "Farbwegschlag" (printing ink drying) and printability.

Similar results are obtained with the urea-formaldehyde polymerisate according to Instruction J.

We claim:

1. A coating composition for paper, which composition consists of an aqueous preparation containing at least:

(a) a polymeric binder selected from the group of starch, modified starch, styrene-butadiene copolymers or acrylic polymers in an amount of 5 to 30 percent by weight relative to the total weight of (b) and (c), (b) an inorganic pigment selected from the group of precipitated calcium carbonate, coating-kaolin and mixtures thereof in an amount of 75 to 98 percent by weight relative to the total weight of constituents (b) and (c), and (c) a water-insoluble urea-formaldehyde polycondensation product produced in aqueous solution from 1 mole of urea and 1.3 to 2 moles of formaldehyde, which product is in a highly dispersed form and has a mean particle diameter of 3 to 6 microns and a specific BET-surface area of 5 to 8 $m^2/g$ in an amount of 25 to 2 percent by weight relative to the total weight of constituents (b) and (c).

2. A coating composition according to claim 1 wherein constituent (c) is a polycondensation product from 1 mole of urea and 1.3 to 1.8 moles of formaldehyde.

3. A coating composition according to claim 1 wherein constituent (c) is a polycondensation product from 1 mole of urea and 1.5 moles of formaldehyde.

4. A coating composition according to claim 1 wherein constituent (c) has a bulk density of 100 to 200 g/l.

5. A coating composition according to claim 1 wherein the solids content of the composition is 40 to 70 percent by weight.

6. A coating composition according to claim 5 having a viscosity of 1000 to 1600 cP.

7. A coating composition according to claim 5 having a solids content of 54 to 60 percent by weight.

8. A coating composition according to claim 1 wherein the percent by weight of the constituent (a) is 5 to 15 percent.

* * * * *